US007445137B2

(12) United States Patent
Noh et al.

(10) Patent No.: US 7,445,137 B2
(45) Date of Patent: Nov. 4, 2008

(54) DISPENSER FOR REFRIGERATOR

(75) Inventors: Hyo-seok Noh, Gwangju (KR); Jae-sek Oh, Gwangju (KR)

(73) Assignee: Samsung Electronics Co., Ltd., Suwon (KR)

( * ) Notice: Subject to any disclaimer, the term of this patent is extended or adjusted under 35 U.S.C. 154(b) by 332 days.

(21) Appl. No.: 11/305,000

(22) Filed: Dec. 19, 2005

(65) Prior Publication Data

US 2006/0131324 A1 Jun. 22, 2006

(30) Foreign Application Priority Data

Dec. 20, 2004 (KR) ..... 10-2004-0108838

(51) Int. Cl.
*B65D 47/00* (2006.01)

(52) U.S. Cl. ..... 222/477; 62/344; 251/77

(58) Field of Classification Search ..... 62/344; 141/351; 222/477; 251/77, 303
See application file for complete search history.

(56) References Cited

U.S. PATENT DOCUMENTS 3,537,132 A * 11/1970 Alvarez ..... 62/266
3,942,334 A * 3/1976 Pink ..... 62/266
4,069,545 A * 1/1978 Holet et al. ..... 16/49
4,090,641 A * 5/1978 Lindenschmidt ..... 222/504
6,267,272 B1 * 7/2001 Shin ..... 222/505

FOREIGN PATENT DOCUMENTS

| | | |
|---|---|---|
| KR | 10-0285847 | 1/2001 |
| KR | 2001-0026278 | 4/2001 |
| KR | 2001-0029590 | 4/2001 |
| KR | 2001-0055612 | 7/2001 |

* cited by examiner

*Primary Examiner*—William E Tapolcai
(74) *Attorney, Agent, or Firm*—Sughrue Mion, PLLC

(57) ABSTRACT

A refrigerator including a dispenser casing on which an ice discharge opening is formed and an opening/closing member placed in the dispenser casing for opening/closing the ice discharge opening. The dispenser also includes a lever member connected with the opening/closing member for making the opening/closing member rotate toward an open position; a damper member operated by the opening/closing member for controlling the closing speed of the opening/closing member when the opening/closing member rotates toward a close position; and a lever return member disposed between the dispenser casing and the lever member, the lever return member returning the lever member to an initial position independent of the closing speed of the opening/closing member. Thus, the return speeds of the opening/closing member and the lever member operate independent of each other.

6 Claims, 9 Drawing Sheets

DISPENSER FOR REFRIGERATOR

This application claims the benefit of Korean Patent Application No. 2004-0108838, filed on Dec. 20, 2004, in the Korean Intellectual Property Office, the disclosure of which is incorporated herein by reference.

BACKGROUND OF THE INVENTION

1. Field of the Invention

The present invention relates to a dispenser for a refrigerator, and, more particularly, to a dispenser for a refrigerator in which the return speeds of an opening/closing member and a lever member operate independently.

2. Description of the Related Art

Korean Patent Application No. 1997-0080299 discloses a conventional refrigerator which comprises a main body that is divided into a refrigerating compartment and a freezing compartment. A refrigerating compartment door and a freezing compartment door are coupled to the main body to open and close the refrigerating compartment and the freezing compartment, respectively. A dispenser for supplying water and ice is installed in the freezing compartment door.

As shown in FIGS. 1 and 2, an ice maker 61 for supplying ice to the dispenser is installed in the freezing compartment and includes an ice carrier member 64, which is driven by a power supply (not shown).

A discharge opening 62 for discharging ice from the ice maker 61 is formed in the freezing compartment door. A switch 63 for controlling the ice discharged from ice maker 61, a closing plate 43 for elastically closing the discharge opening 62, a push lever 49, which is connected to the closing plate 43, for operating the switch 63 and a damper, installed on a first side of the discharge opening 62, for slowing down the closing plate 43 are all installed below the discharge opening 62.

The damper comprises a deceleration part 70, which is installed adjacent to the discharge opening 62 and in an inside portion of the freezing compartment door, and an operating part 80. One end of the operating part 80 moves with the deceleration part 70, and the other end of operating part 80 is connected to a side of the push lever 49.

The deceleration part 70 comprises a pair of casings 71 disposed in an inside portion of the freezing compartment door and formed with a working groove 72 in one side, an oil damper 73 disposed in an inside portion of casing 71 and having at least one tooth 74, and a deceleration gear 75 that engages the oil damper 73.

When a user compresses the push lever 49 in order to extract ice from the ice maker 61, the lower portion of the push lever 49 rotates with respect to a rotating shaft 48 and contacts the switch 63. Then, the ice carrier member 64 operates in accordance with the operation of the switch 63. In addition, the upper portion of the push lever 49 rotates forward with respect to the rotating shaft 48 and pulls the operating part 80. Hence, the operating part 80 moves forward and makes the deceleration gear 75 rotate. In addition, the closing plate 43 moves to open the discharge opening 62.

When the user releases the push lever 49, the closing plate 43 and the push lever 49 return to their initial positions automatically by the force of an elastic member 44. The closing plate 43 and the push lever 49 are slowly rotated by the damper. Because the return speed of the closing plate 43 is slowed, the ice has sufficient time to discharged from the discharge opening 62. Thus, the damper solves the problem of ice remaining in the discharge opening 62.

However, because the push lever and the closing plate are interdependent in the conventional refrigerator, the damper simultaneously slows the return speeds of both the closing plate and the push lever. Accordingly, the return time of the push lever is delayed. Because the return of the push lever is delayed when released by the user, customers think that the push lever of the refrigerator is defective.

Thus, in order to acquire customer trust in the goods, it would be advantageous to independently operate the return speeds of the closing plate and the push lever.

SUMMARY OF THE INVENTION

Accordingly, it is an aspect of the present invention to provide a dispenser for a refrigerator in which the return speeds of an opening/closing member and a lever member are independent of each other.

Additional aspects and/or advantages of the present invention will be set forth in part in the description which follows and, in part, will be obvious from the description, or may be learned by practice of the present invention.

The foregoing and/or other aspects of the present invention are also achieved by providing a dispenser for a refrigerator comprising a dispenser casing on which an ice discharge opening is formed and an opening/closing member placed in the dispenser casing for opening and closing the ice discharge opening. The dispenser further comprising: a lever member connected to the opening/closing member for rotating the opening/closing member toward an open position; a damper member operated by the opening/closing member for controlling the closing speed of the opening/closing member when the opening/closing member rotates toward a close position; and a lever return member disposed between the dispenser casing and the lever member. The lever return member returns the lever member independent of the closing speed of the opening/closing member.

According to an aspect of the present invention, the lever return member comprises an elastic member providing a return force to the lever member.

According to an aspect of the present invention, the dispenser for the refrigerator further comprises a cover panel connected to the dispenser casing for covering the opening/closing member and the lever member, wherein the lever return member is connected between the cover panel and the lever member.

According to an aspect of the present invention, the elastic member comprises a torsion coil spring having a body, a first arm extended from the body and supported by the lever member, and a second arm extended from the body and supported by the cover panel.

According to an aspect of the present invention, the cover panel comprises a body insertion part into which the body of the torsion coil spring is inserted, and a second arm supporter supporting the second arm of the torsion coil spring, wherein the lever member comprises a first arm supporter supporting the first arm of the torsion coil spring.

According to an aspect of the present invention, a dispenser for the refrigerator further comprises a locking part that is formed on the opening/closing member and the lever member. The locking part is locked when the opening/closing member rotates toward the open position and unlocked when the opening/closing member rotates toward the close position.

According to an aspect of the present invention, the locking part comprises a locking projection formed on one of the lever member and the opening/closing member, and a projection-accommodating groove formed on the other one of the lever member and the opening/closing member for accommodating the locking projection.

BRIEF DESCRIPTION OF THE DRAWINGS

The above and/or other aspects and advantages of the present invention will become apparent and more readily appreciated from the following description of the embodiments, taken in conjunction with the accompanying drawings, in which.

Figure 1:
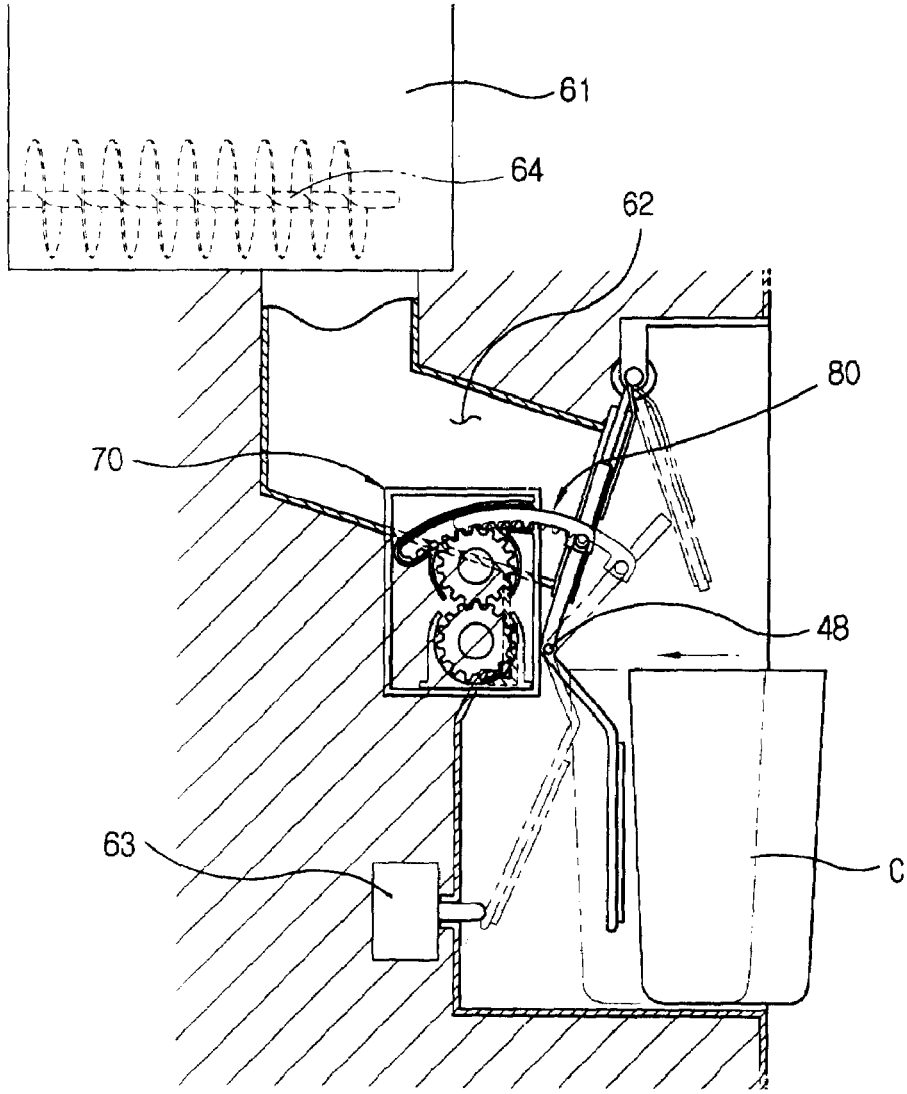
FIG. 1 (PRIOR ART)
FIG. 1 is a sectional view illustrating a conventional refrigerator on which a dispenser is installed.
Figure 2:
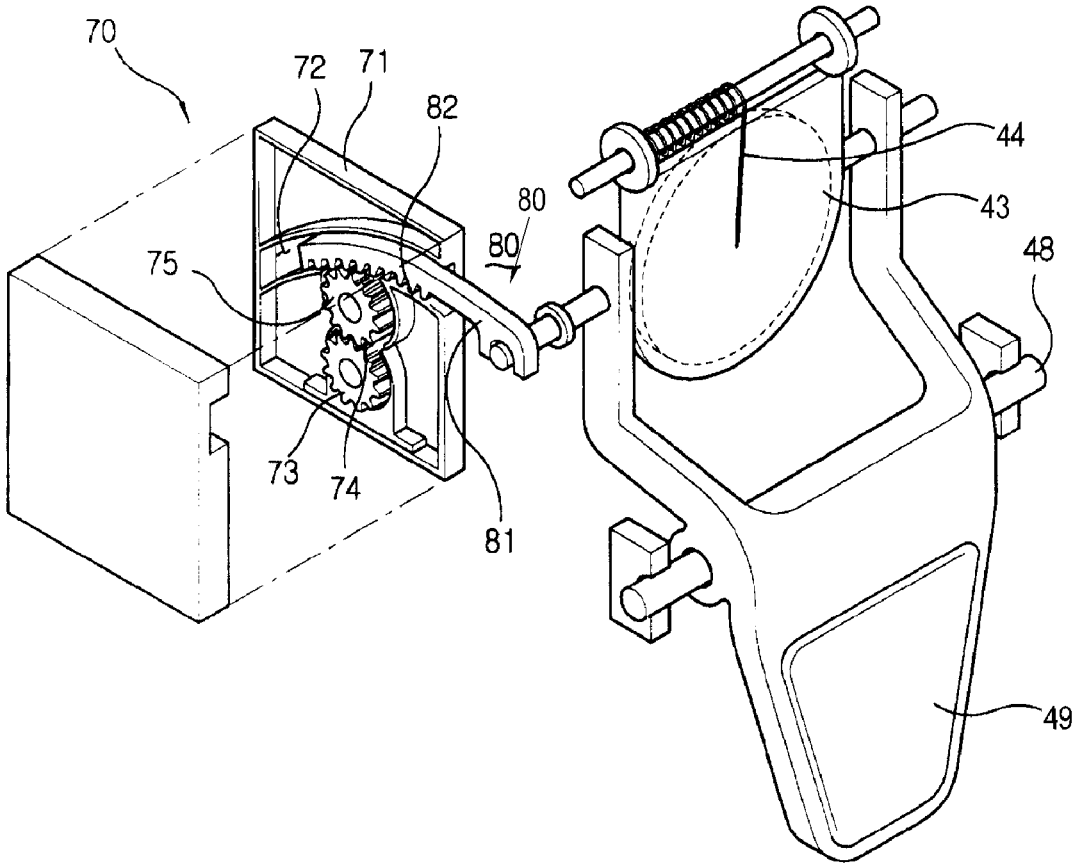
FIG. 2 (PRIOR ART)
FIG. 2 is a perspective view illustrating a damper of the conventional refrigerator.

DETAILED DESCRIPTION OF ILLUSTRATIVE NON-LIMITING EMBODIMENTS OF THE PRESENT INVENTION

Reference will now be made in detail to the embodiments of the present invention, examples of which are illustrated in the accompanying drawings, wherein like reference numerals refer to like elements throughout.

Figure 3:
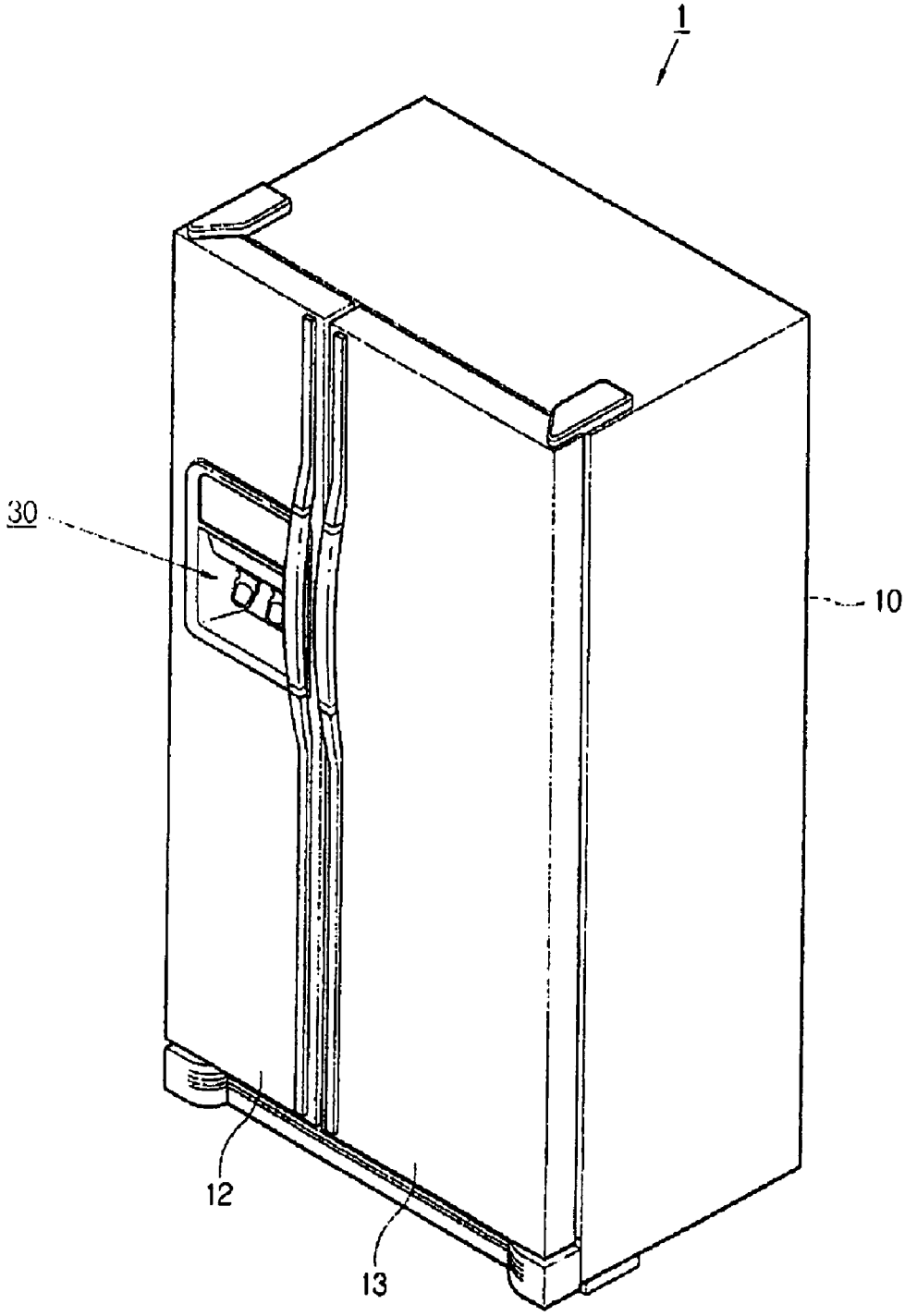
FIG. 3 is a front perspective view illustrating a dispenser installed on the refrigerator according to the present invention.
Figure 4:
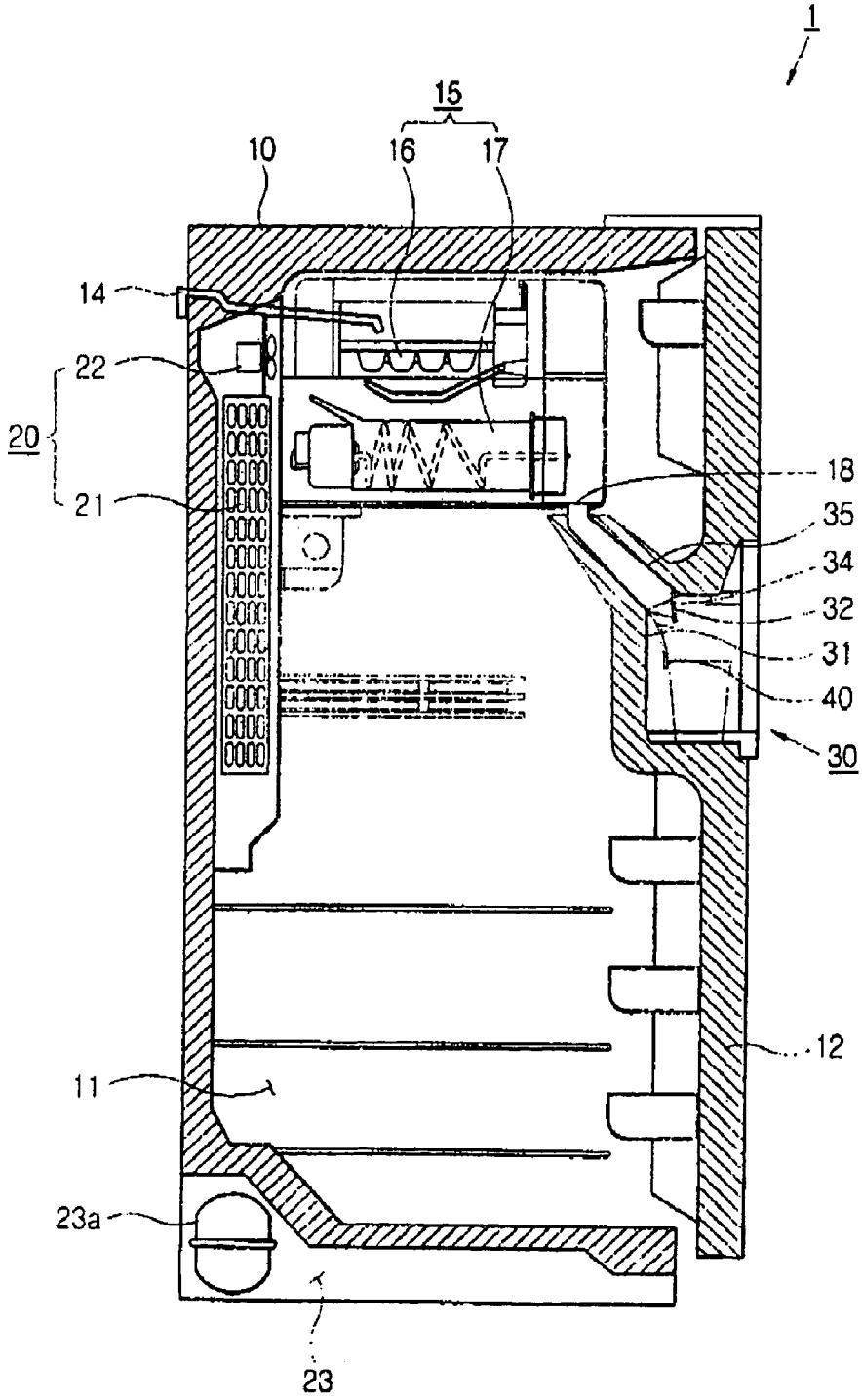
FIG. 4 is a schematic sectional view of the freezing compartment in FIG. 3.
Figure 5:
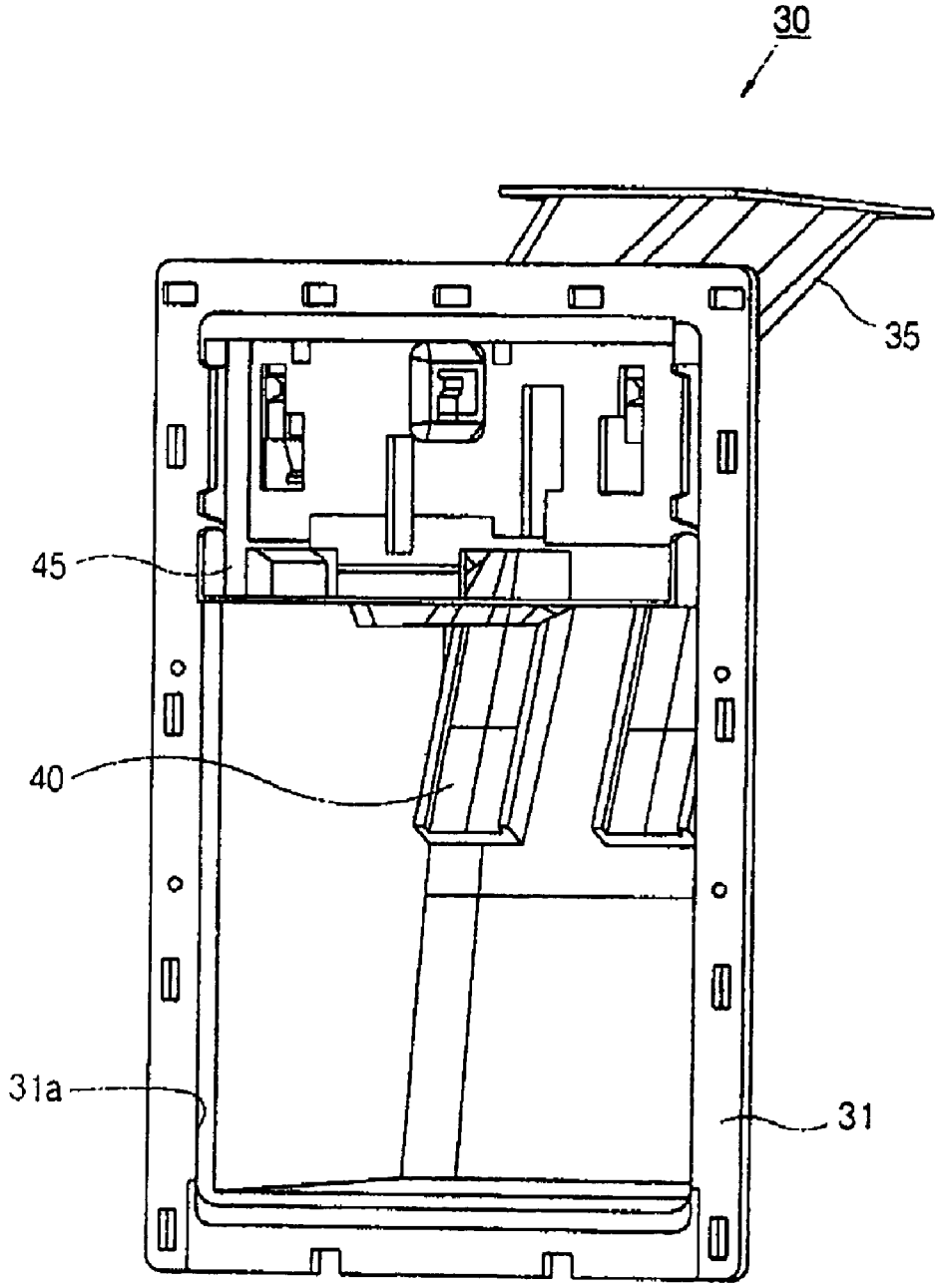
FIG. 5 is a front perspective view of the dispenser for the refrigerator according to the present invention.
Figure 6:
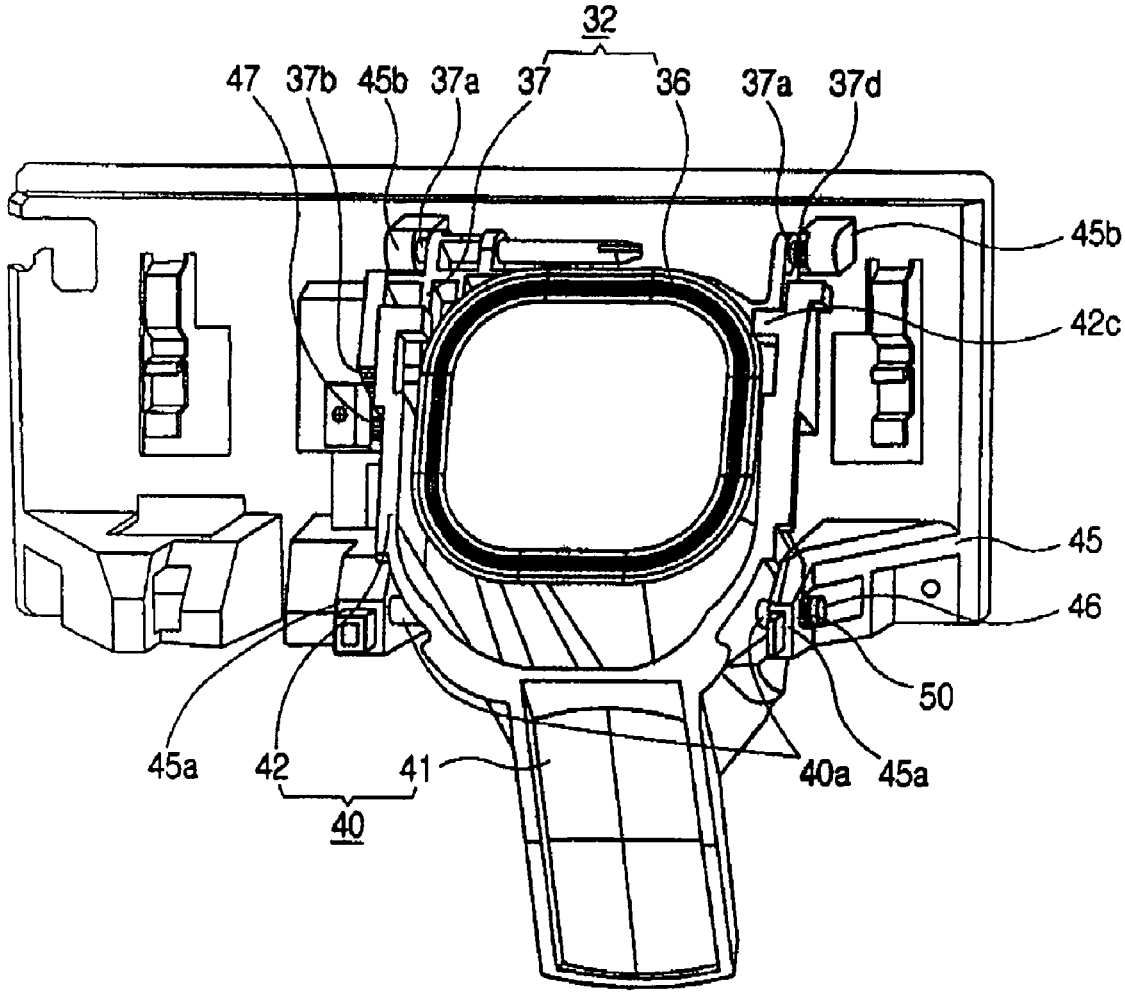
FIG. 6 is a rear perspective view of the dispenser for the refrigerator according to the present invention.

As shown in FIGS. 3 and 4, a refrigerator 1, comprising a dispenser 30 according to the present invention, comprises a cabinet 10 vertically divided into a freezing compartment 11 and a refrigerating compartment(not shown) by a partition. A freezing compartment door 12 and a refrigerating compartment door 13 are rotatably installed on a front face of the cabinet 10. The doors respectively open and close the freezing compartment 11 and the refrigerating compartment.

A dispenser 30 is disposed in the freezing compartment door 12 for supplying water from a water supply or for discharging ice from an ice making device 15 located in the freezing compartment 11.

A component chamber 23 equipped with a compressor 23*a* and a condenser(not shown) are provided in a rear, lower portion of the cabinet 10. A cool air supplier 20, which comprises an evaporator 21 for generating cool air and a fan 22 for circulating the cool air from the evaporator 21 to the freezing compartment 11, is provided in a rear portion of the cabinet 10.

A water hose 14, which penetrates from the outside through a foaming material is provided in the freezing compartment 11. The freezing compartment 11 also includes the ice making device 15 having an ice maker 16 for generating ice from water supplied from the water hose 14, and an ice supplier 17 for storing the ice that is separated from the ice maker 16. The ice supplier 17 also supplies ice to the dispenser 30, which is located below the ice maker 16. An ice outlet 18, which provides an ice flow path to the dispenser 30, is formed on a lower surface of the ice supplier 17.

As shown in FIGS. 5, 6 and 7A-7C, the dispenser 30 comprises a dispenser casing 31 having a front opening 31 a, and an ice discharge opening 34 (reference to FIG. 4) communicating with the ice outlet 18; an opening/closing member 32 for opening and closing the ice discharge opening 34 of the dispenser casing 31; a lever member 40 connected to the opening/closing member 32 for making the opening/closing member 32 rotate toward an open position; a damper member 47 operated by the opening/closing member 32 for controlling the closing speed of the opening/closing member 32 when the opening/closing member 32 rotates toward the close position; a lever return member 50 connected between the dispenser casing 31 and the lever member 40; and a front plate(not shown) attached on a front surface of the dispenser casing 31 for forming the external appearance. The lever return member 50 returns the lever member 40 to its initial position independent of the closing speed of the opening/closing member 32. The dispenser 30 further comprises a locking part 60 formed on the opening/closing member 32 and the lever member 40 for locking or unlocking the lever member 40 and the opening/closing member 32.

A discharge pipe 35, which guides ice from the ice outlet 18 to the ice discharge opening 34, is installed on an upper surface of the dispenser casing 31. A cover panel 45 for covering the opening/closing member 32 and the lever member 40 in installed at a front upper portion of the dispenser casing 31.

The lever member 40, which is rotatably coupled with respect to the dispenser casing 31, makes the opening/closing member 32 rotate toward the open position. Rotating shaft 40*a* is projected on opposite sides of the lever member 40. A pair of shaft supporters 45*a* for rotatably supporting each of the rotating shafts 40*a* are formed in the cover panel 45.

The lever member 40 comprises a push lever 41 provided in a lower part of the rotating shaft 40*a* and a link 42 provided in an upper part of the rotating shaft 40*a*. The lever member 40 is locked or unlocked with the opening/closing member 32.

A locking projection 42*c* is formed on the link 42 of the lever member 40 toward the opening/closing member 32 (to be described later). Thus, if a user presses the push lever 41 of the lever member 40 backward, the ice discharge opening 34 may be opened because the link 42, which is locked with the opening/closing member 32, pushes the opening/closing member 32 forward.

A body insertion part 46 into which a body 51 of a torsion coil spring 50 (to be described later) is inserted is projected on an external surface of one of the shaft supporters 45*a* of the cover panel 45.

The opening/closing member 32 comprises a seal cover 36, which seals the ice discharge opening 34, and a supporting bracket 37 on which a pivoting shaft 37*a* is formed. The supporting bracket 37 is extended outside of the seal cover 36.

The pivoting shaft 37*a* of the supporting bracket 37 is rotatably coupled with respect to a shaft coupling 45*b* formed on the cover panel 45. Preferably, but not necessarily, a first end of a torsion coil spring 37*d* is supported by the supporting bracket 37 and a second end of the torsion coil spring 37*d* is supported by the shaft coupling 45*b*, which is coupled to the pivoting shaft 37*a*. Thus, the opening/closing member 32 closes the ice discharge opening 34 by using the elastic force of the torsion coil spring 37*d*.

A gear 37*b* engaged with the damper member 47 is disposed on a side portion of the supporting bracket 37. When the opening/closing member 32 rotates toward the close position, the closing speed of the opening/closing member 32 may be slowed by engaging gear 37*b* with the damper member 47. Because the opening/closing member 32 slowly closes the ice discharge opening 34, there is sufficient time for ice discharged from the ice maker device 15 to exit from discharge opening 34. A projection-accommodating groove 37*c* (reference to FIG. 7C) is formed in one region of the supporting bracket 37 for accommodating a locking projection 42*c* (to be described later) of the lever member 40.

The damper member 47 is installed at the side part of the cover panel 45. The damper member 47 engages with the gear 37*b* and decreases the closing speed of the opening/closing member 32.

The lever return member 50 is coupled to the lever member 40 and the cover panel 45, and makes the lever member 40 return to the initial position quickly if a user releases the lever member 40. The lever return member 50 may be an elastic member that supplies a return force to the lever member 40. Preferably, but not necessarily, the lever return member 50 may be a torsion coil spring, but not limited thereto. Alternately, the elastic member may be a plate spring, a rubber, etc.

When the lever return member 50 is a torsion coil spring, the torsion coil spring 50 comprises a body 51, a first arm 52 extended from the body 51 and supported by the lever member 40, and a second arm 53 extended from the body 51 and supported by the cover panel 45.

The body 51 of the torsion coil spring 50 is inserted into the body insertion part 46 of the cover panel 45.

The first arm 52 is supported by a first arm supporter 42*a* formed on the link 42 of the lever member 40.

The second arm 53 is supported by a second arm supporter 46*a* formed on the cover panel 45.

Herein, the torsion coil spring 50 is provided on one side of the lever member 40 and the cover panel 45. Alternately, the torsion coil spring 50 may be provided on the other side thereof. Also, the torsion coil spring 50 may be provided on both sides of the lever member 40 and cover panel 45.

Figure 7A:
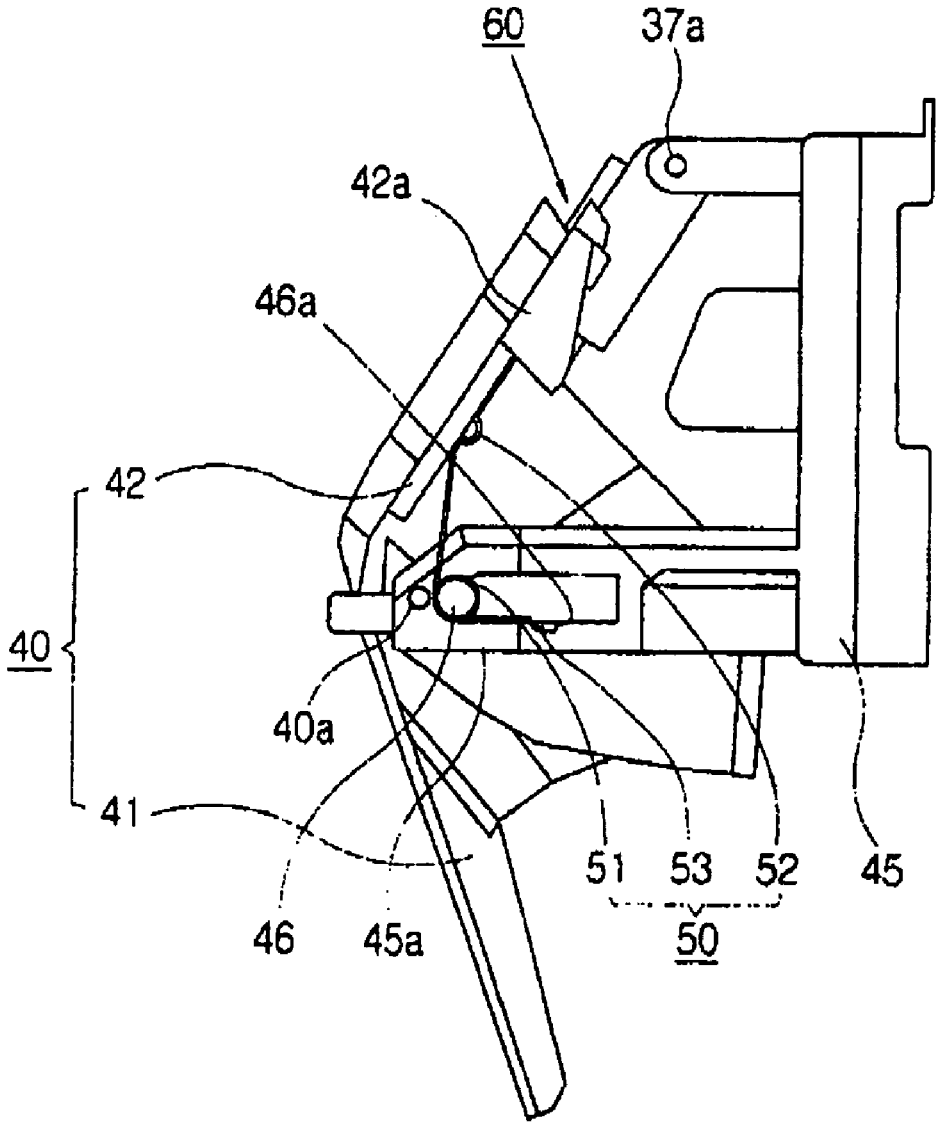
FIGS. 7A through 7C are side views illustrating the operating state of a lever member and an opening/closing member of the dispenser for the refrigerator according to the present invention.
Figure 7B:
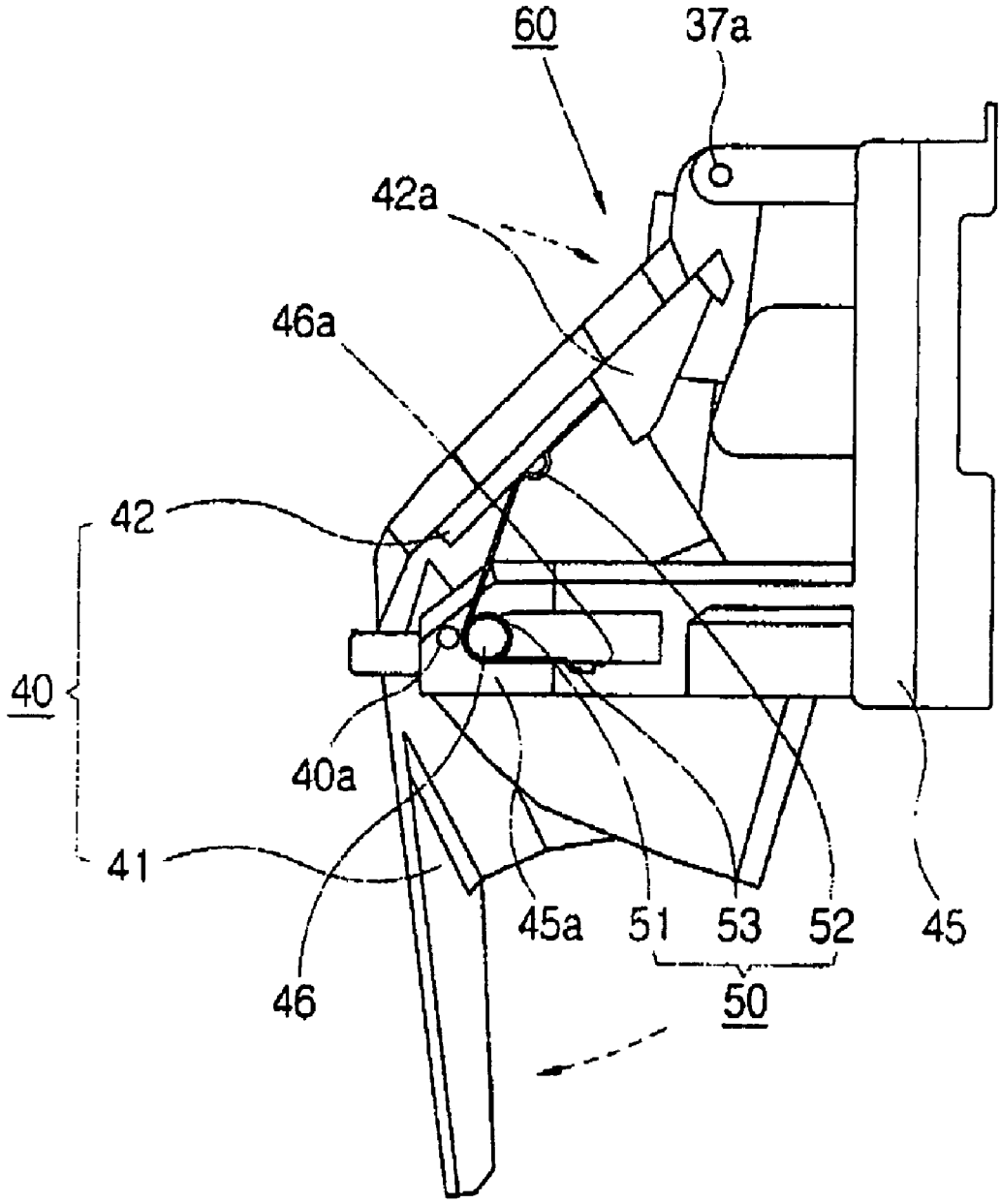
Figure 7C:
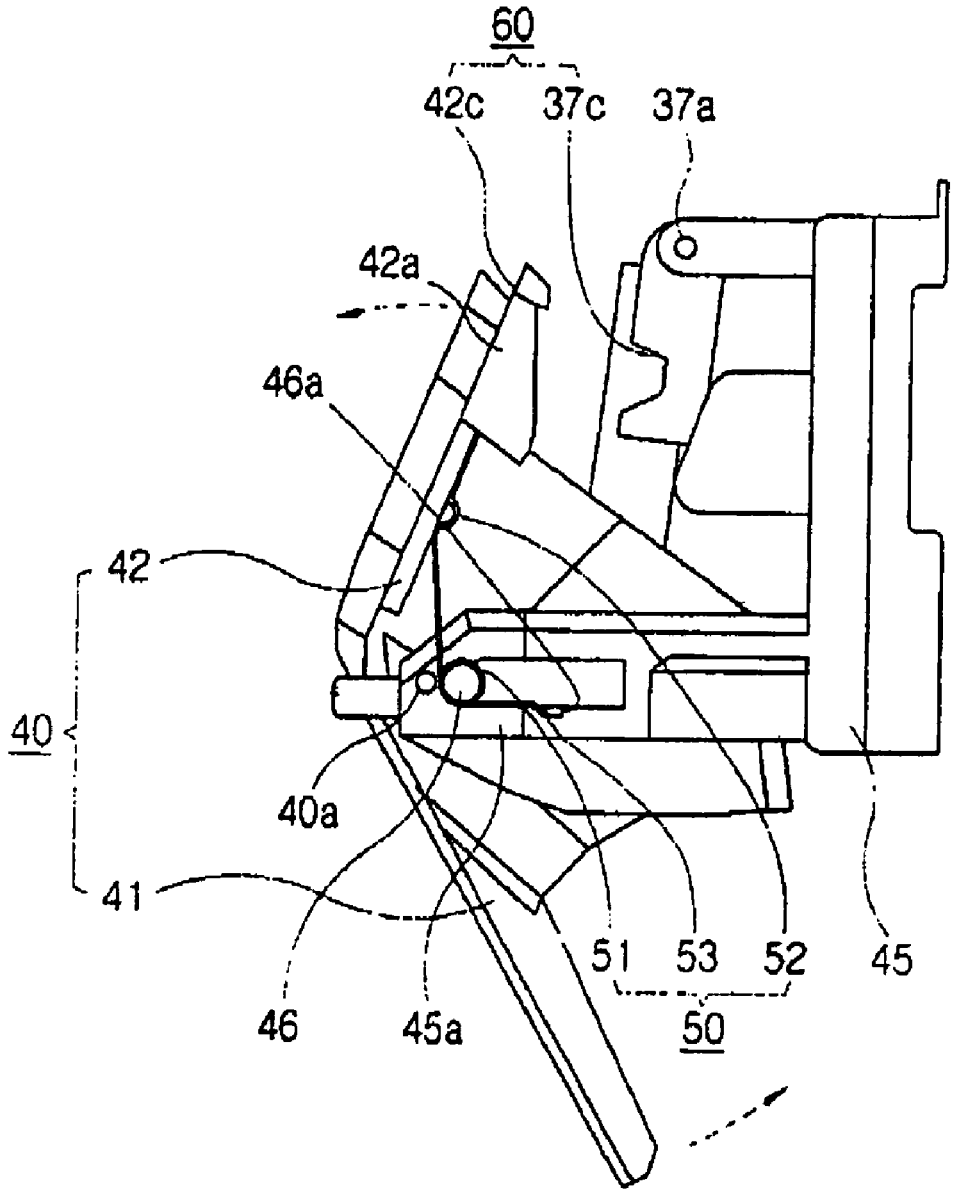

As shown in FIG. 7C, the locking part 60 comprises the locking projection 42*c* of the lever member 40 and the projection-accommodating groove 37*c* of the supporting bracket 37. Thus, the lever member 40 locks with the opening/closing member 32 when the lever member 40 is pressed and the opening/closing member 32 is rotated toward the open position, and the lever member 40 unlocks with the opening/closing member 32 when the lever member 40 is quickly returned to its initial position by the lever return member 50 (e.g., torsion coil spring) when the lever member 40 is released and the opening/closing member 32 is rotated toward the close position.

With this configuration, the operating states of the lever member 40 and the opening/closing member 32 in the dispenser 30 for the refrigerator according to the present invention will be described with reference to FIGS. 7A through 7C.

As shown in FIG. 7A, the opening/closing member 32 keeps the ice discharge opening 34 closed by an elastic force from the torsion coil spring 37*d*.

Then, if a user presses the push lever 41 of the lever member 40, as shown in FIG. 7B, the push lever 41 of the lever member 40 rotates backward with respect to the rotating shaft 40*a* and the link 42 of the lever member 40 and produces a forward rotation on the opening/closing member 32. Therefore, with a forward rotation with respect to the pivoting shaft 37*a*, the opening/closing member 32 opens the ice discharge opening 34. In addition, the locking projection 42*c* of the lever member 40 is inserted into the projection-accommodating groove 37*c* of the opening/closing member 32 during the forward rotation.

Once a user releases the lever member 40, as shown in FIG. 7C, the push lever 41 of the lever member 40 is rotated forward by the lever return member 50 and the locking projection 42*c* unlocks from the projection-accommodation groove 37*c*. The closing speed of the opening/closing member 32 is slowed by the damper member 47. Accordingly, the opening/closing member 32 slowly rotates backward and closes the ice discharge opening 34 as shown in FIG. 7A.

In the foregoing embodiment, the locking projection is formed on the lever member and the projection-accommodating groove is formed on the opening/closing member. Alternatively, the projection-accommodating groove may be formed on the lever member and the locking projection may be formed on the opening/closing member.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A dispenser for a refrigerator, comprising:

a dispenser casing on which an ice discharge opening is formed;

an opening/closing member disposed in the dispenser casing, the opening/closing member adapted to open and close the ice discharge opening;

a lever member connected with the opening/closing member, the lever member adapted to move the opening/closing member toward an open position;

a damper member operated by the opening/closing member, the damper member adapted to control a closing speed of the opening/closing member when the opening/closing member rotates toward a close position;

a lever return member disposed between the dispenser casing and the lever member, the lever return member adapted to return the lever member to an initial position independent of the closing speed of the opening/closing member; and a cover panel connected to the dispenser casing, the cover panel adapted to cover the opening/closing member and the lever member, wherein the lever return member is connected between the cover panel and the lever member.

2. The dispenser for the refrigerator according to claim 1, wherein the lever return member comprises an elastic member providing a return force to the lever member.

3. The dispenser for the refrigerator according to claim 1, wherein the elastic member comprises a torsion coil spring having a body, a first arm extended from the body and supported by the lever member, and a second arm extended from the body and supported by the cover panel.

4. The dispenser for the refrigerator according to claim 3, wherein the cover panel comprises a body insertion part adapted to accept the body of the torsion coil spring, and a second arm supporter supporting the second arm of the torsion coil spring, wherein the lever member comprises a first arm supporter supporting the first arm of the torsion coil spring.

5. The dispenser for the refrigerator according to claim 1, further comprising:

a locking part formed on the opening/closing member and the lever member, the locking part is adapted to be locked when the opening/closing member rotates toward the open position and unlocked when the opening/closing member rotates toward the close position.

6. The dispenser for the refrigerator according to claim 5, wherein the locking part comprises a locking projection formed on one of the lever member and the opening/closing member, and a projection-accommodating groove formed on the other one of the lever member and the opening/closing member, the projection-accommodating groove adapted to accommodate the locking projection.

* * * * *